US011131505B2

(12) United States Patent
Jiang

(10) Patent No.: US 11,131,505 B2
(45) Date of Patent: Sep. 28, 2021

(54) FINNED HEAT-EXCHANGE SYSTEM

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 37 days.

(21) Appl. No.: 16/784,917

(22) Filed: Feb. 7, 2020

(65) Prior Publication Data

US 2020/0173725 A1 Jun. 4, 2020

Related U.S. Application Data

(63) Continuation of application No. PCT/CN2018/099032, filed on Aug. 6, 2018.

(30) Foreign Application Priority Data

Aug. 8, 2017 (CN) ..... 201720983947.8

(51) Int. Cl.

| | |
|---|---|
| ***F28D 1/04*** | (2006.01) |
| ***F28D 1/02*** | (2006.01) |
| ***F21V 29/503*** | (2015.01) |
| ***F21V 29/67*** | (2015.01) |
| ***F28D 1/053*** | (2006.01) |

(Continued)

(52) U.S. Cl.

CPC ..... *F28D 1/024* (2013.01); *F21V 29/503* (2015.01); *F21V 29/673* (2015.01); *F21V 29/677* (2015.01); *F28D 1/0408* (2013.01); *F28D 1/05333* (2013.01); *F28F 1/14* (2013.01); *F28F 1/24* (2013.01); *F21W 2131/406* (2013.01)

(58) Field of Classification Search

CPC .... F28D 1/024; F28D 1/0408; F28D 1/05333; F21V 29/203; F21V 29/673; F21V 29/677; F28F 1/14; F21W 2131/406

USPC ..... 165/151

See application file for complete search history.

(56) References Cited

U.S. PATENT DOCUMENTS

2006/0181894 A1 8/2006 Chinniah et al.
2012/0127744 A1* 5/2012 Lin ..... F21S 45/43 362/487

(Continued)

FOREIGN PATENT DOCUMENTS

CN 200952670 Y 9/2007
CN 104214747 A 12/2014

(Continued)

OTHER PUBLICATIONS

International Search Report for PCT/CN2018/099032 dated Oct. 15, 2018; 2 pages.

(Continued)

*Primary Examiner* — Davis D Hwu

(74) *Attorney, Agent, or Firm* — Lerner, David, Littenberg, Krumholz & Mentlik, LLP

(57) ABSTRACT

The present invention provides a finned heat-exchange system, comprising a heat dissipation chamber, a fin, an air guide element and a base, wherein the heat dissipation chamber is isolated from the outside, and both the fin and the air guide element are connected to the base; and the air guide element and the fin are in communication with the heat dissipation chamber through the base to dissipate heat from the inside of the heat dissipation chamber.

10 Claims, 3 Drawing Sheets

(51) Int. Cl.

| | |
|---|---|
| ***F28F 1/14*** | (2006.01) |
| ***F28F 1/24*** | (2006.01) |
| *F21W 131/406* | (2006.01) |

(56) References Cited

U.S. PATENT DOCUMENTS

| | | | | |
|---|---|---|---|---|
| 2012/0201031 | A1 | 8/2012 | Marley | |
| 2013/0107531 | A1* | 5/2013 | Breidenassel | F21V 29/70 362/249.02 |
| 2013/0135857 | A1* | 5/2013 | Chen | F21S 8/086 362/235 |

FOREIGN PATENT DOCUMENTS

| | | | |
|---|---|---|---|
| CN | 105960125 | A | 9/2016 |
| CN | 207378785 | U | 5/2018 |
| JP | H05144305 | A | 6/1993 |
| JP | 2010257760 | A | 11/2010 |
| KR | 20080006979 | A | 1/2008 |

OTHER PUBLICATIONS

Extended European Search Report including Written Opinion for Application No. EP188432512, dated May 12, 2020, pp. 1-11.

* cited by examiner

FINNED HEAT-EXCHANGE SYSTEM

CROSS REFERENCE TO RELATED APPLICATIONS

The present application is a continuation of International Application No. PCT/CN2018/099032, filed on Aug. 6, 2018, which claims priority from Chinese Patent Application No. 201720983947.8 filed on Aug. 8, 2017, all of which are hereby incorporated herein by reference.

TECHNICAL FIELD

The present invention relates to the technical field of heat-exchange system, and more particularly to a finned heat-exchange system.

BACKGROUND

When some electrical devices (e.g., a stage light) are in use, various electronic components therein, especially light sources, will generate a large amount of heat. If the heat is not transferred in time, it will be accumulated inside an enclosure to cause the temperature to rise, and the excessive temperature will affect the use effect and service life of the lamp. When the stage light requires IP65 protection and thus a housing is completely sealed, the temperature rise due to heat accumulation will be more serious. Therefore, it is necessary to efficiently reduce the internal environment temperature of the stage light with high level of protection with the housing completely sealed.

In the prior art, the internal heat is transferred to the housing through internal forced circulation and then is conducted to an outer surface of the enclosure through the housing for natural heat dissipation so as to achieve the transfer of internal heat to the external environment. In the prior art, due to the limitation of the material of the housing and the manufacturing process level, a common problem is low heat exchange efficiency caused by large heat transfer resistance and insufficient heat exchange area.

SUMMARY OF THE INVENTION

The present invention provides a finned heat-exchange system, which is simple in structure, is convenient to use, has a large heat exchange area, has high heat exchange efficiency, and can extend the service life of a device to be cooled.

According to the present invention, the finned heat-exchange system comprises a heat dissipation chamber, a fin, an air guide element and a base. The heat dissipation chamber is isolated from the outside, and both the fin and the air guide element are connected to the base; and the air guide element and the fin are in communication with the heat dissipation chamber through the base to dissipate heat from the inside of the heat dissipation chamber. The outside is the natural environment.

With the finned heat-exchange system being installed inside a device to be cooled, when the device to be cooled generates heat, the heat will enter the air guide element from the heat dissipation chamber and will be dissipated by means of the fin, and during heat dissipation, the heat dissipation chamber and the air guide element can form a circulation channel to increase the heat exchange area and improve the heat exchange efficiency. The finned heat-exchange system thus can extend the service life of the device to be cooled.

Preferably, the air guide element is composed of several air guide pipes. Further preferably, the air guide pipes are embedded into the fin, and two ends of each of the air guide pipes are in communication with the heat dissipation chamber through the base. Still further preferably, the adjacent air guide pipes are evenly disposed at equal intervals. With such arrangement, heat can be evenly transferred into the air guide pipe, thereby ensuring better dissipation of heat.

Preferably, the heat dissipation chamber comprises an air inlet cavity and an air outlet cavity. With such arrangement, when heat enters the air guide element from the air inlet cavity, part of the heat will be dissipated to the outside via the fin, the other part of the heat will continue to be transferred into the air outlet cavity, and the heat flowing out of the air outlet cavity can enter the air inlet cavity again, thereby achieving the circulation of heat. Moreover, the arrangement of the air inlet cavity and the air outlet cavity can increase the length of the circulation channel, which facilitates better circulation and dissipation of heat to the outside.

Preferably, two ends of each of the air guide pipes are respectively arranged inside the air inlet cavity and the air outlet cavity. Such arrangement can ensure better transfer and dissipation of heat.

Preferably, one end, at the air inlet cavity and/or the air outlet cavity, of each of the air guide pipes can extend to any position outside the air inlet cavity and/or the air outlet cavity. Further preferably, all the air guide pipes are different in length extending out of the air inlet cavity and/or the air outlet cavity. Such arrangement can achieve better transfer and dissipation of heat and bring a significant heat dissipation effect.

Preferably, each of the air guide pipes is provided with an auxiliary air guide device at an extension end at the air inlet cavity and/or the air outlet cavity. With such arrangement, the heat generated by the device to be cooled can be smoothly transferred into the air inlet cavity and the air outlet cavity, which is convenient for the circulation of heat in the circulation channel, thereby improving the heat dissipation effect. The auxiliary air guide device can be an air guide plate.

Preferably, the heat-exchange system further comprises a first air-driving device provided at any position in an air channel extension path of the air inlet cavity or the air outlet cavity. The configuration of the first air-driving device can enhance air convection inside the heat dissipation chamber.

Preferably, the heat-exchange system further comprises a second air-driving device used for enhancing the efficiency of heat exchange between the fin and the outside. Further preferably, the second air-driving device has an air direction parallel to the fin. With such arrangement, the heat-exchange system can achieve better heat dissipation effect.

Compared with the prior art, the present invention can achieve some beneficial effects. According to the finned heat-exchange system of the present invention, the finned heat-exchange system is typically installed inside a device to be cooled, when the device to be cooled generates heat, the heat can enter the air guide element from the heat dissipation chamber and can be dissipated by means of the fin, and during heat dissipation, the heat dissipation chamber and the air guide element can form a circulation channel to increase the heat exchange area and improve the heat exchange efficiency. The finned heat-exchange system can extend the service life of the device to be cooled.

DETAILED DESCRIPTION OF EMBODIMENTS

Figure 1:
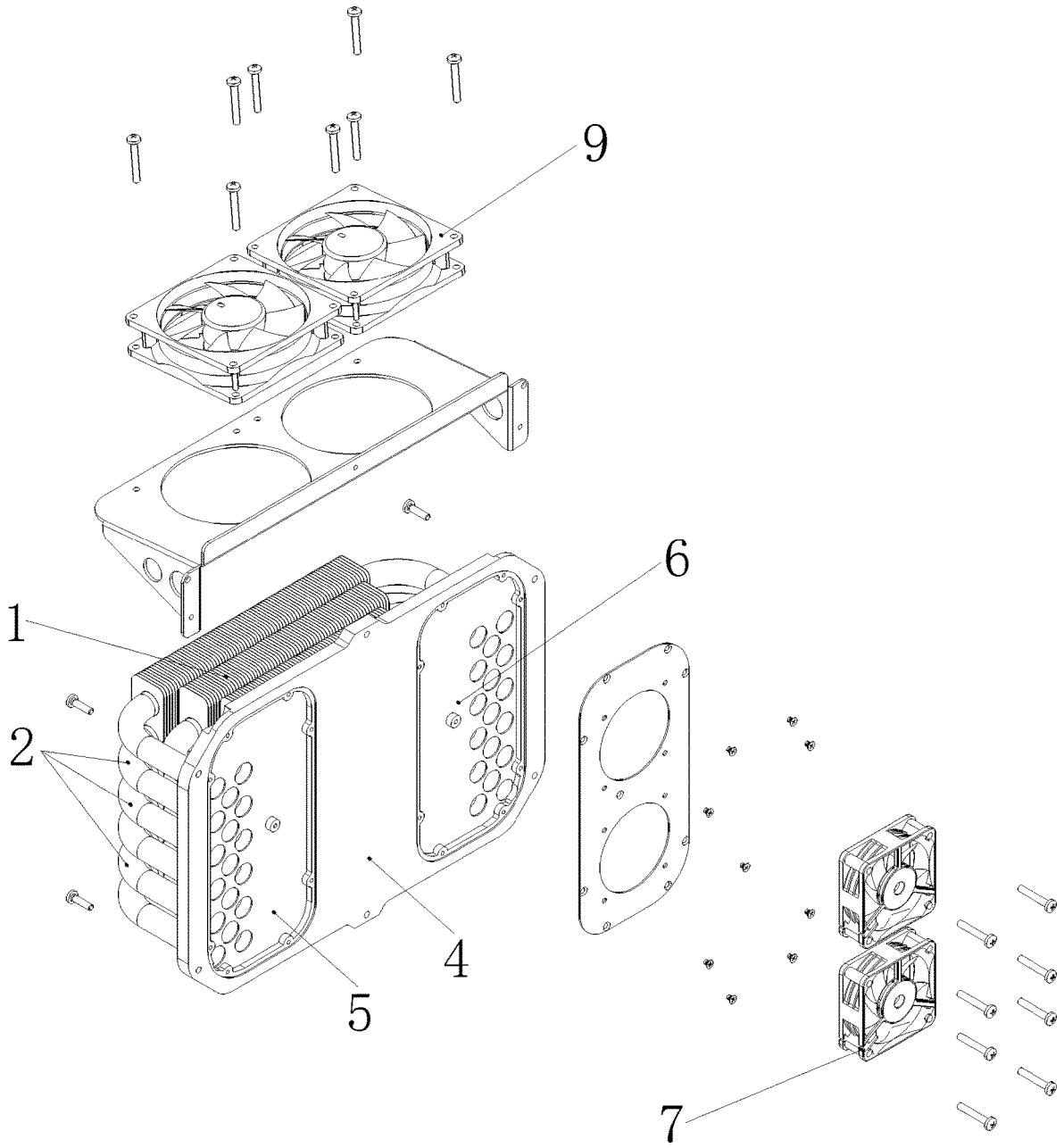
FIG. 1 is an exploded view of a finned heat-exchange system according to an embodiment.
Figure 2:
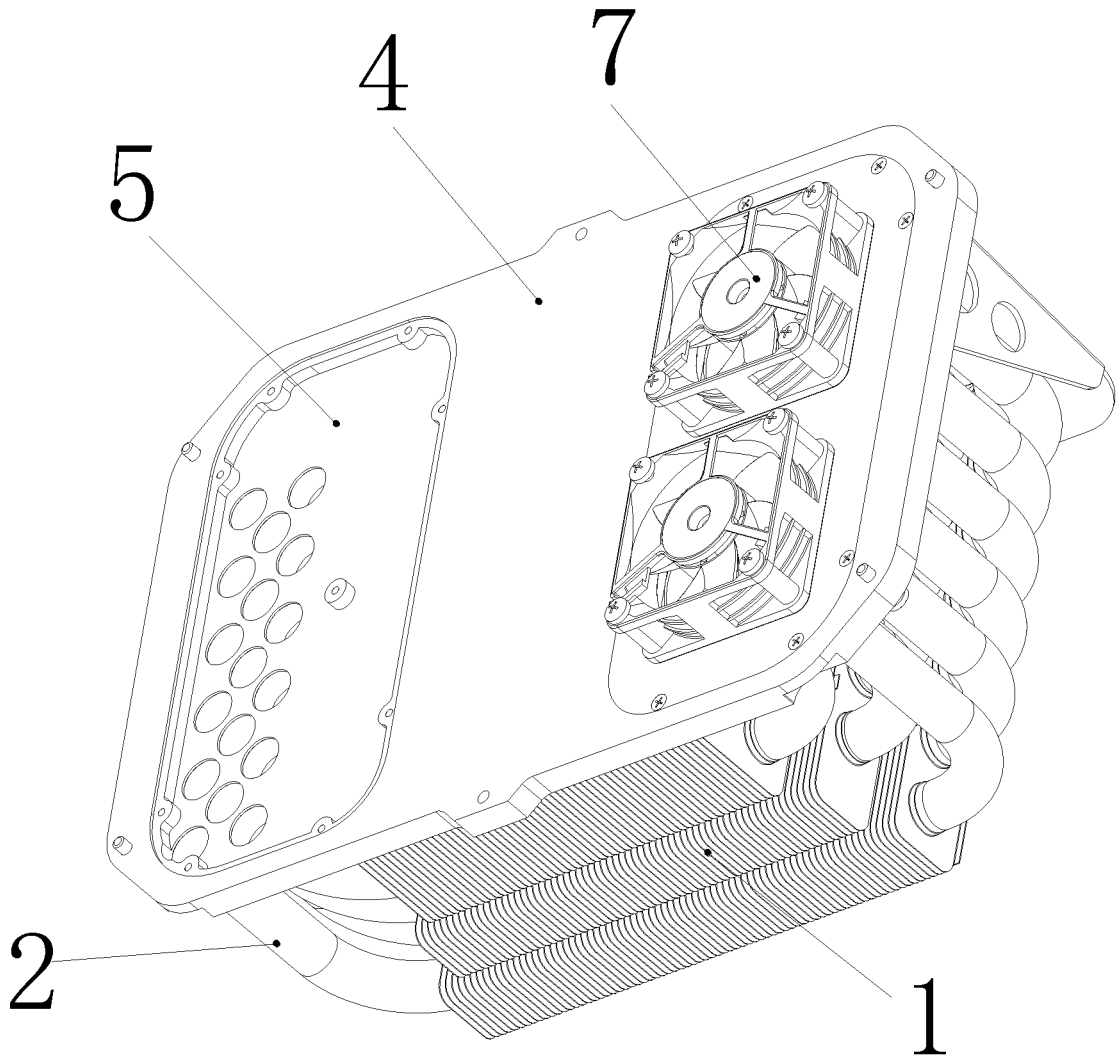
FIG. 2 is a structural schematic diagram of a finned heat-exchange system according to the embodiment.
Figure 3:
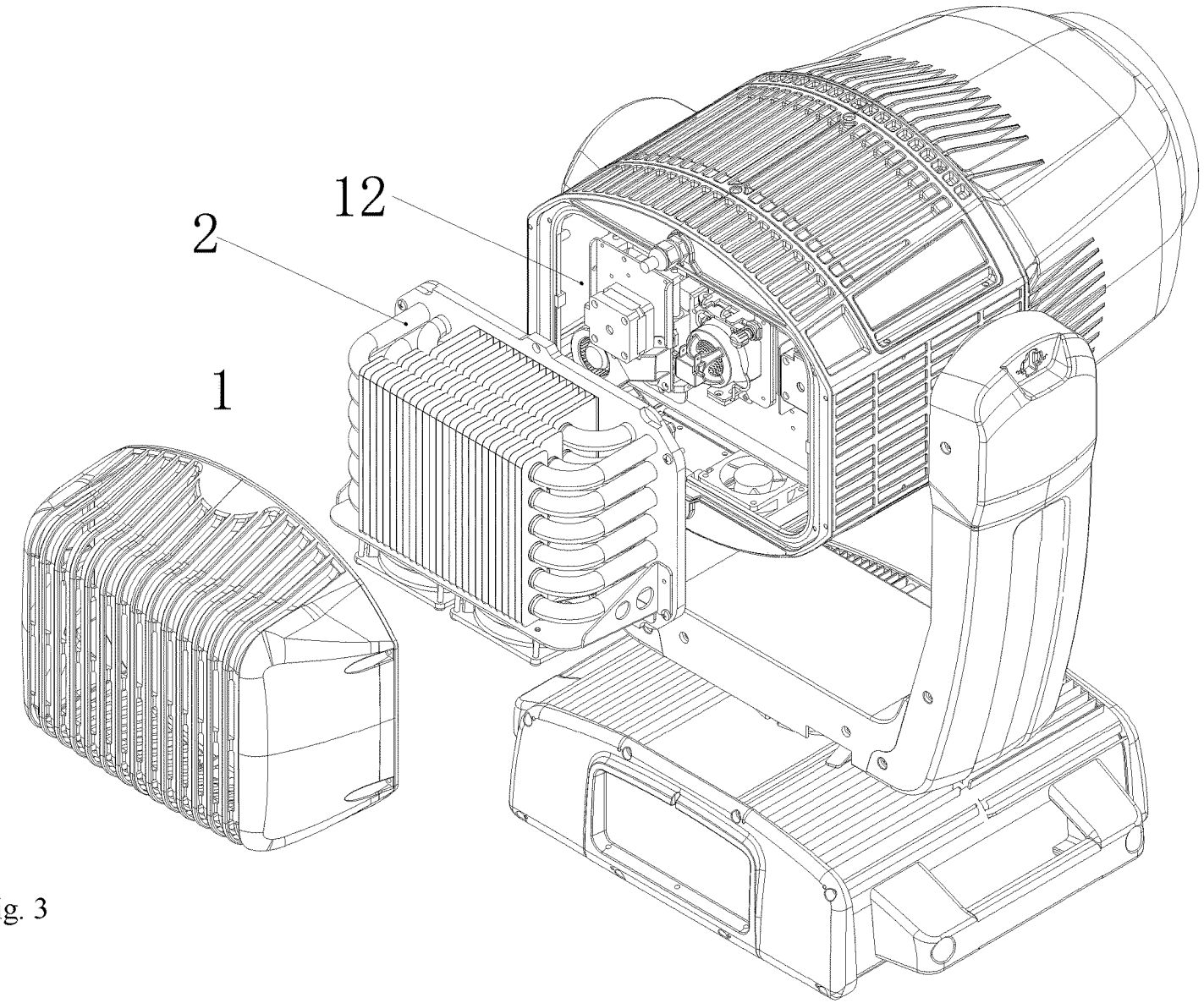
FIG. 3 is a schematic diagram of the finned heat-exchange system being installed inside a stage light to perform heat exchange.

In the present embodiment, a finned heat-exchange system, with schematic diagrams as shown in FIGS. 1 and 2, comprises a heat dissipation chamber, a fin 1, an air guide element 2 and a base 4. The heat dissipation chamber is isolated from the outside, and both the fin 1 and the air guide element 2 are connected to the base 4; and the air guide element 2 and the fin 1 are in communication with the heat dissipation chamber through the base 4 to dissipate heat from the inside of the heat dissipation chamber. The outside is the natural environment.

The finned heat-exchange system can be installed inside a device to be cooled. Particularly, in the present embodiment, the device to be cooled is a stage light, and the finned heat-exchange system is installed in an inner cavity 12 of the light. When a light-emitting component of the stage light generates heat, the heat will enter the air guide element 2 from the heat dissipation chamber and will be dissipated by means of the fin 1, and during heat dissipation, the heat dissipation chamber and the air guide element 2 can form a circulation channel to increase the heat exchange area and improve the heat exchange efficiency. The finned heat-exchange system thus can extend the service life of the stage light.

According to the present embodiment, the air guide element 2 is composed of several air guide pipes. In this embodiment, the air guide pipes are embedded into the fin 1, and two ends of each of the air guide pipes are in communication with the heat dissipation chamber through the base 4. The adjacent air guide pipes are evenly disposed at equal intervals. With such arrangement, heat can be evenly transferred into the air guide pipe, thereby ensuring better dissipation of heat.

In addition, the heat dissipation chamber comprises an air inlet cavity 6 and an air outlet cavity 5. With such arrangement, when heat enters the air guide element 2 from the air inlet cavity 6, part of the heat will be dissipated to the outside via the fin 1, the other part of the heat will continue to be transferred into the air outlet cavity 5, and the heat flowing out of the air outlet cavity 5 can enter the air inlet cavity 6 again, thereby achieving the circulation of heat. Moreover, the arrangement of the air inlet cavity 6 and the air outlet cavity 5 can increase the length of the circulation channel, which facilitates better circulation and dissipation of heat to the outside.

Two ends of each of the air guide pipes are respectively arranged inside the air inlet cavity 6 and the air outlet cavity 5. Such arrangement can ensure better transfer and dissipation of heat.

In addition, one end, at the air inlet cavity 6 and/or the air outlet cavity 5, of each of the air guide pipes can extend to any position outside the air inlet cavity 6 and/or the air outlet cavity 5. In this embodiment, all the air guide pipes are different in length extending out of the air inlet cavity 6 and/or the air outlet cavity 5. Such arrangement can achieve better transfer and dissipation of heat and bring a significant heat dissipation effect.

Each of the air guide pipes is provided with an auxiliary air guide device at an extension end at the air inlet cavity 6 and/or the air outlet cavity 5. With such arrangement, the heat generated by a light-emitting element can be smoothly transferred into the air inlet cavity 6 and the air outlet cavity 5, which is convenient for the circulation of heat in the circulation channel, thereby improving the heat dissipation effect. The auxiliary air guide device is an air guide plate.

In addition, the heat-exchange system further comprises a first air-driving device 7 provided at any position in an air channel extension path of the air inlet cavity 6 or the air outlet cavity 5. The configuration of the first air-driving device 7 can enhance air convection inside the heat dissipation chamber. In this embodiment, the first air-driving device 7 is arranged at any position in the air channel extension path of the air inlet cavity 6.

The heat-exchange system further comprises a second air-driving device 9 for enhancing the efficiency of heat exchange between the fin 1 and the outside. In this embodiment, the second air-driving device 9 has an air direction parallel to the fin 1. With such arrangement, the heat-exchange system can achieve better heat dissipation effect.

The invention claimed is:

1. A finned heat-exchange system, comprising a heat dissipation chamber, a fin, an air guide element and a base, wherein the heat dissipation chamber is isolated from the outside, and both the fin and the air guide element are connected to the base; the air guide element and the fin are in communication with the heat dissipation chamber through the base to dissipate heat from an inside of the heat dissipation chamber, and wherein the air guide element is composed of several air guide pipes, the several air guide pipes are embedded into the fin, and two ends of each of the several air guide pipes are in communication with the heat dissipation chamber through the base.

2. The finned heat-exchange system according to claim 1, wherein the several air guide pipes are evenly disposed at equal intervals.

3. The finned heat-exchange system according to claim 1, wherein the heat dissipation chamber comprises an air inlet cavity and an air outlet cavity.

4. The finned heat-exchange system according to claim 3, wherein two ends of each of the several air guide pipes are respectively arranged inside the air inlet cavity and the air outlet cavity.

5. The finned heat-exchange system according to claim 3, wherein one end, at the air inlet cavity or the air outlet cavity, of each of the several air guide pipes extends to any position outside the air inlet cavity and/or the air outlet cavity.

6. The finned heat-exchange system according to claim 5, wherein all the several air guide pipes are different in length extending out of the air inlet cavity or the air outlet cavity.

7. The finned heat-exchange system according to claim 5, wherein each of the several air guide pipes is provided with an auxiliary air guide device at an extension end at the air inlet cavity or the air outlet cavity.

8. The finned heat-exchange system according to claim 4, further comprising a first air-driving device provided at any position in an air channel extension path of the air inlet cavity or the air outlet cavity, wherein the first air-driving device is configurated for enhancing air convection inside the heat dissipation chamber.

9. The finned heat-exchange system according to claim 8, further comprising a second air-driving device for enhancing efficiency of heat exchange between the fin and the outside.

10. The finned heat-exchange system according to claim 9, wherein the second air-driving device has an air direction parallel to the fin.

* * * * *